US007182443B2

(12) United States Patent
Salim et al.

(10) Patent No.: US 7,182,443 B2
(45) Date of Patent: Feb. 27, 2007

(54) INK DELIVERY SYSTEM

(75) Inventors: Senarto Salim, Singapore (SG); Nadia Nalaningrum Moertiyoso, Singapore (SG); Pui Shing Wong, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 310 days.

(21) Appl. No.: 10/882,709

(22) Filed: Jun. 30, 2004

(65) Prior Publication Data

US 2006/0001706 A1 Jan. 5, 2006

(51) Int. Cl.
*B41J 2/175* (2006.01)

(52) U.S. Cl. ..... 347/85

(58) Field of Classification Search ..... 347/85; 141/2, 18; 137/15.19, 115.13, 505.25
See application file for complete search history.

(56) References Cited

U.S. PATENT DOCUMENTS 4,558,326 A * 12/1985 Kimura et al. ..... 347/30
5,257,646 A * 11/1993 Meyer ..... 137/505.25
5,881,757 A * 3/1999 Kuster et al. ..... 137/15.19
5,917,526 A * 6/1999 Wilson et al. ..... 347/86
6,290,343 B1 * 9/2001 Lewis et al. ..... 347/85
6,374,853 B1 * 4/2002 Callies ..... 137/495
6,582,068 B2 * 6/2003 Ishizawa et al. ..... 347/85
7,025,445 B2 * 4/2006 Thielman et al. ..... 347/85
2002/0024571 A1 2/2002 Childers et al.
2002/0093556 A1 7/2002 Ishizawa et al.

FOREIGN PATENT DOCUMENTS

EP 1256451 A 11/2002

* cited by examiner

*Primary Examiner*—Anh T. N. Vo

(57) ABSTRACT

An ink delivery system comprises a first container. A second container, at least a portion of which is flexible, contains a supply of ink to be supplied to a print head of a printer. The second container is received within the first container and the second container defines an outlet opening arranged to be accessible externally of the first container. A propellant is interposed between an interior surface of the first container and an external surface of the second container to effect discharge of the ink through the outlet opening of the second container on demand.

5 Claims, 5 Drawing Sheets

INK DELIVERY SYSTEM

FIELD

This invention relates to ink delivery. More particularly, the invention relates to an ink delivery system, to a printer including the ink delivery system and to a component for an ink delivery system.

BACKGROUND

Certain inkjet printers use non-disposable print heads, the print heads being supplied with ink from a disposable ink source. Ink is delivered from the ink source to the print head/s of the printer by a pump mechanism.

The use of the pump mechanism places certain constraints on the design of the printer. The pump mechanism requires mechanical components to withdraw ink from the ink source and to supply the ink to the print head. These mechanical components contribute to the part count, part cost and assembly time of the printer. The mechanical components increase the manufacturing logistics of the printer.

In addition, where the printer has multiple print heads, multiple pump mechanisms are provided to supply each of the print heads. This adds to the complexity of the printer. Still further, the footprint of the printer is larger to accommodate the multiple pump mechanisms.

A pump mechanism also contributes to the noise level of the printer, is subject to wear and tear which can further increase the noise level of the printer, and requires regular maintenance.

SUMMARY

An ink delivery system comprises a first container. A second container, at least a portion of which is flexible, contains a supply of ink to be supplied to a print head of a printer. The second container is received within the first container and the second container defines an outlet opening arranged to be accessible externally of the first container. A propellant is interposed between an interior surface of the first container and an external surface of the second container to effect discharge of the ink through the outlet opening of the second container on demand.

DETAILED DESCRIPTION OF EXEMPLARY EMBODIMENT

Figure 1:
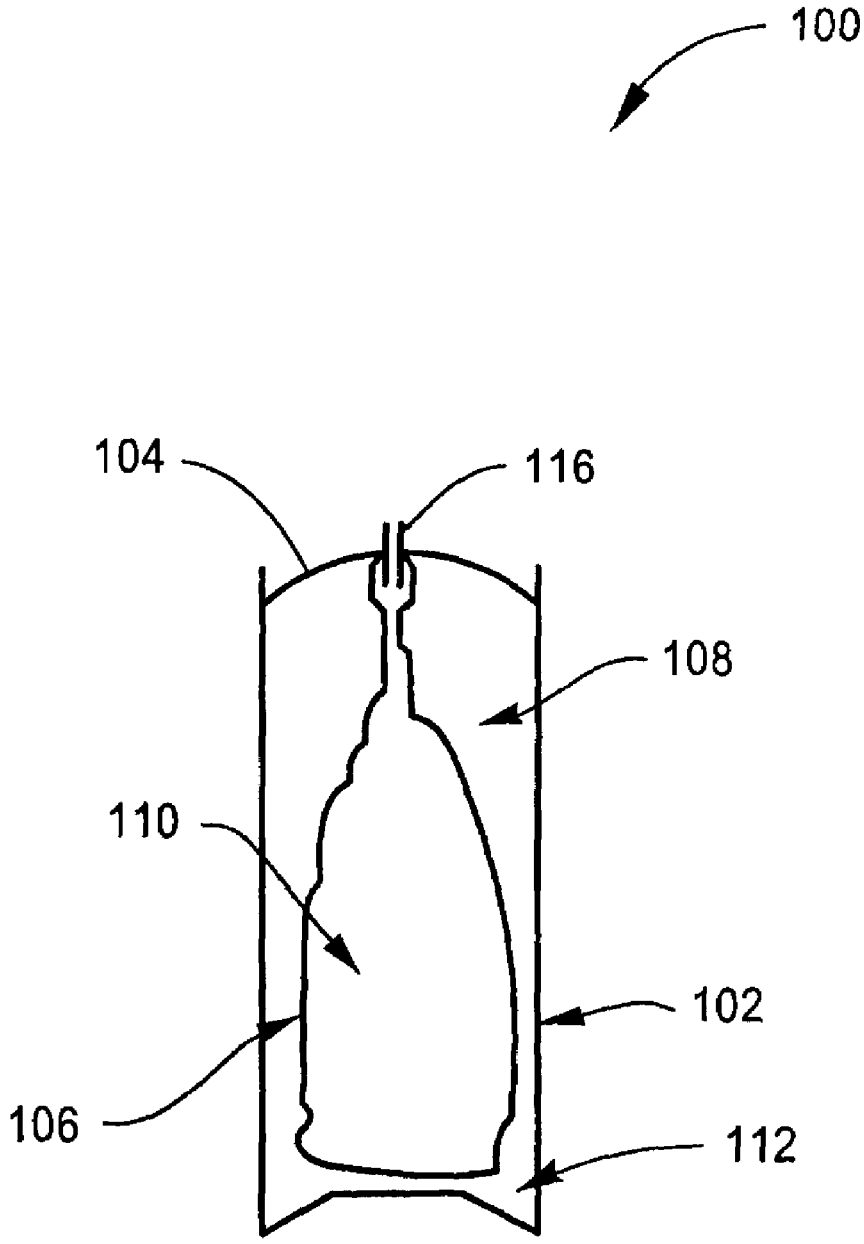
FIG. 1 shows a schematic, sectional side view of an ink delivery system in accordance with an embodiment of the invention.

In FIG. 1 of the drawings, reference numeral 100 generally designates an ink delivery system. The ink delivery system 100 has a first, rigid container in the form of a canister 102 closed off by a top member 104. A second, flexible container in the form of a bladder 106 is contained within an interior 108 of the container 102. The bladder 106 contains a quantity of ink 110.

The interior 108 of the container 102 is maintained under pressure by a propellant 112 arranged in the interior 108 of the container 102, interposed between the containers 102 and 106.

The ink delivery system 100 supplies the ink 110 to a print head, as will be described in greater detail below, at a predetermined pressure. The actual pressure to be maintained on the ink 110 in the bladder 106 is dependent on the print head with which the ink delivery system 100 is used and the flow rate of ink from nozzles of the print head.

This is normally within the range of about 4 to 8 cc/min and, more particularly, about 6 cc/min. To maintain this ejection rate, a gauge pressure that the propellant 112 needs to exert on the ink 110 lies in the range of from about 0.05 atm to 0.75 atm and, more particularly, from about 0.06 to 0.66 atm.

To provide this low pressure, a suitable propellant 112 is a compressed gas, more particularly, compressed nitrogen. The compressed gas gives a stable pressure over a wide temperature range.

To reduce the size of the canister 102 while providing the required pressure on the ink 110, a control device or pressure regulator 114 is connected, in use, to an outlet opening 116 of the bladder 106. The pressure regulator 114 is mounted in a printer 300 (FIG. 3) and connects to the outlet opening 116 of the canister 102.

With the use of an appropriate pressure regulator 114, the size of the canister 102 can be reduced to an article having a height of approximately 12 cm and a diameter in the range of about 3 cm to 4 cm, typically about 3.25 cm to 3.75 cm and, optimally, about 3.34 cm.

Figure 2:
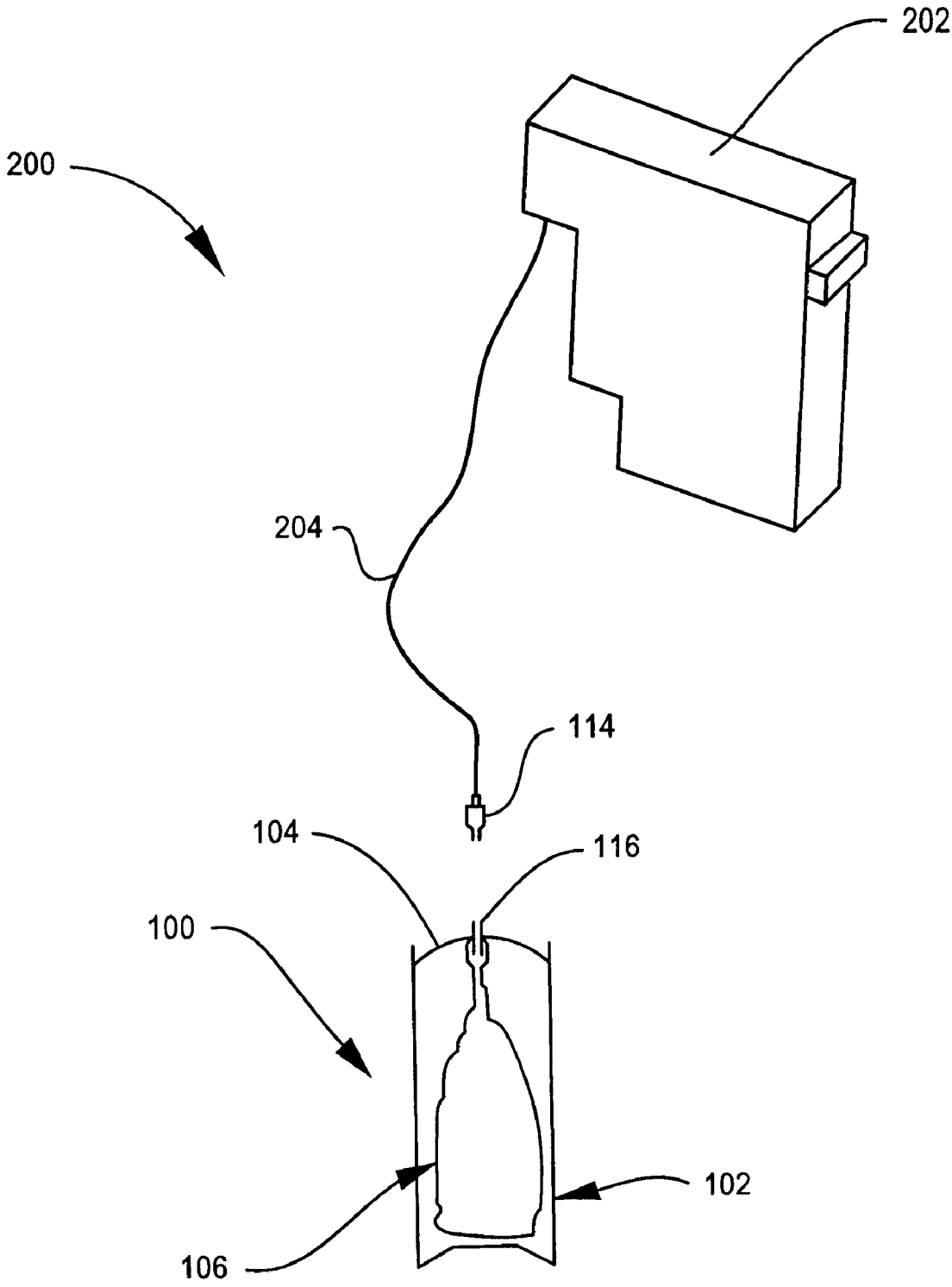
FIG. 2 shows a schematic representation of the ink delivery system connected to a print head.

Referring now to FIG. 2 of the drawings, an ink supply arrangement 200 is shown. The ink supply arrangement 200 includes the ink delivery system 100 which feeds ink to a print head 202 of the printer 300. Ink is supplied to the print heat 202 via a conduit 204 attached to an outlet aperture of the pressure regulator 114.

An advantage of the use of the ink delivery system 100 is that the canister 102 can be arranged in any desired orientation. It is not necessary that the canister 102 be vertically arranged. As a result, and referring now to FIG. 3 of the drawings, a plurality of the canisters 102 can be arranged at any desired location in the printer 300. Thus, canisters 102 can be arranged at a front 302 of the printer, on top of the printer 300 as shown at 304 and/or along a side 306 of the printer 300. It is emphasised that these are but examples of where the canisters 102 can be arranged and any suitable location in the printer 300 could be used to accommodate the canisters 102.

Figure 3:
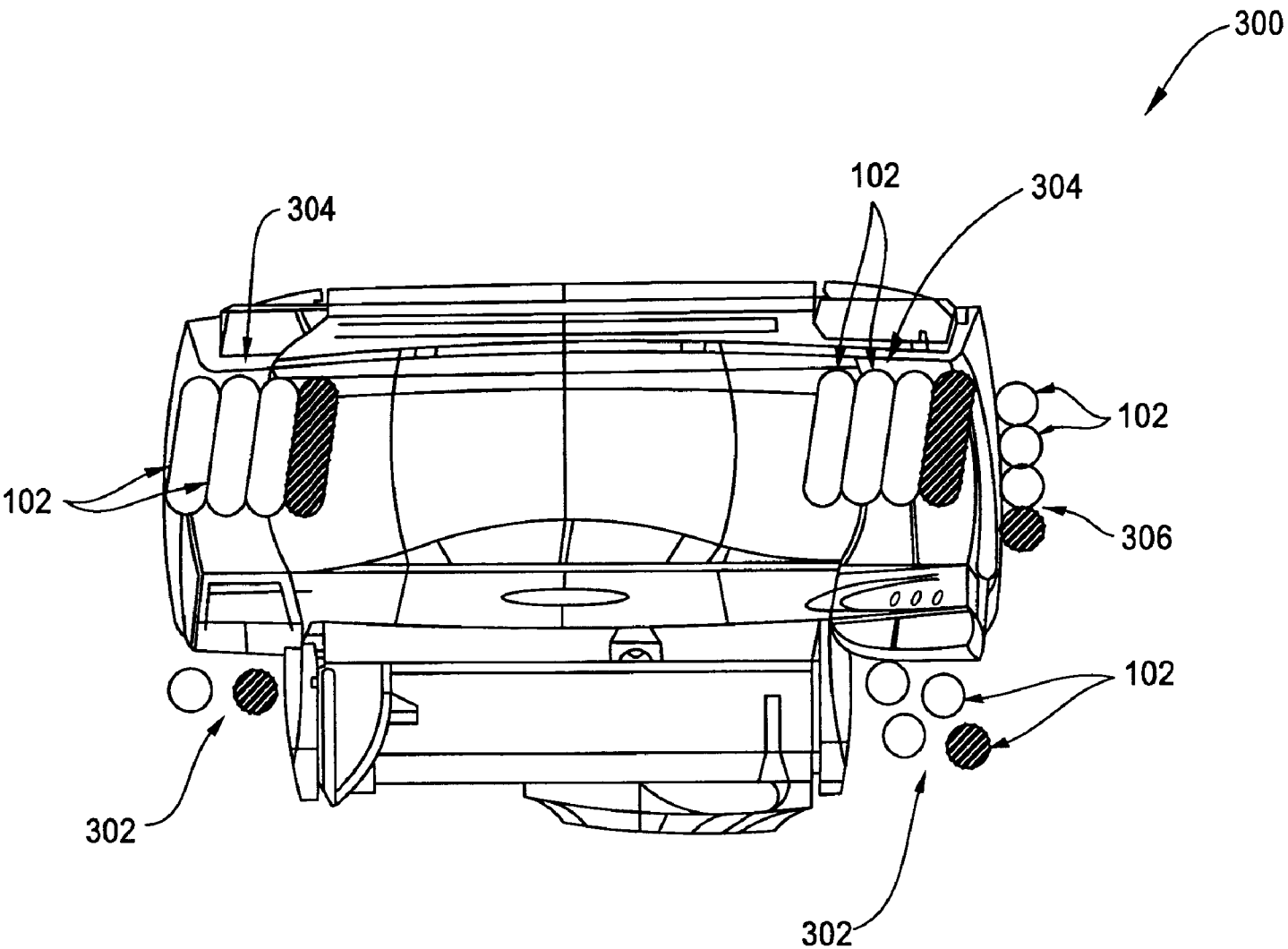
FIG. 3 shows a schematic, plan view of a printer, in accordance with an embodiment of the invention, incorporating the ink delivery system.

It will be appreciated that, because of the small size of the canisters 102, by arranging the canisters 102 in the orientation shown, for example, in FIG. 3 of the drawings, the footprint and the height of the printer 300 are able to be minimised. Consequently, a more compact printer 300 can be developed than one using a pump mechanism for supplying ink to the print head 202.

Figure 4A:
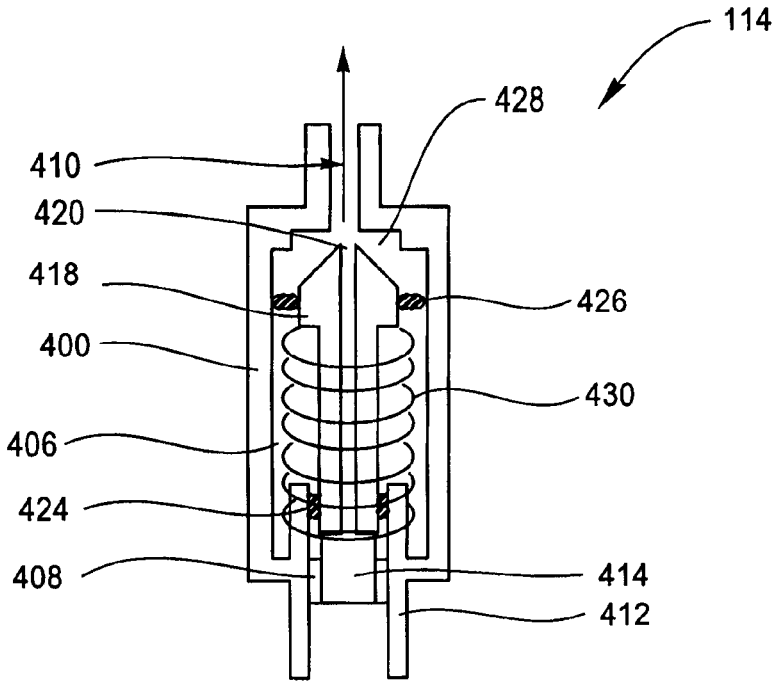
FIG. 4A shows a sectional side view of a component, in accordance with an embodiment of the invention, of the ink delivery system in a closed condition.
Figure 4B:
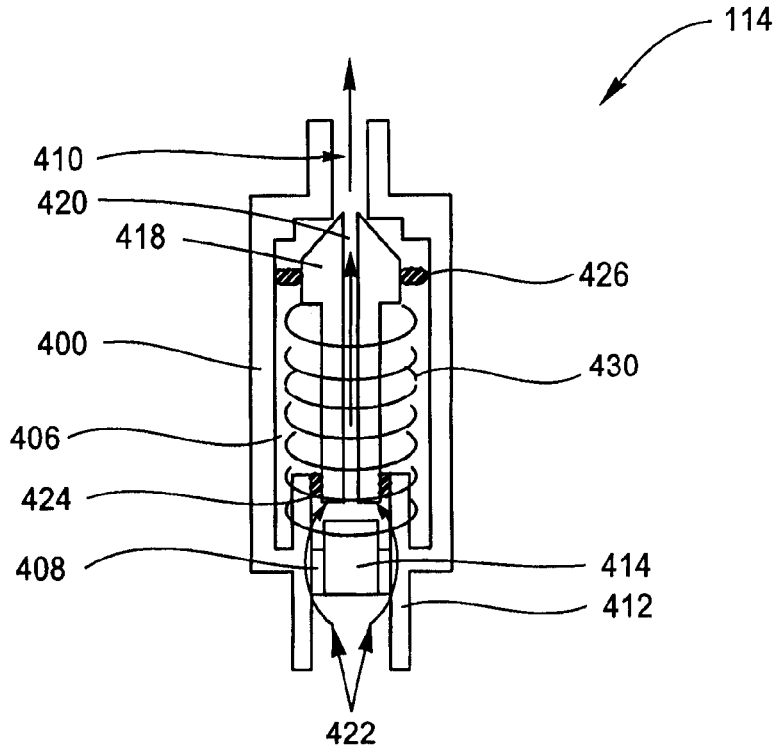
FIG. 4B shows a sectional side view of the component in an open condition.
Figure 4C:
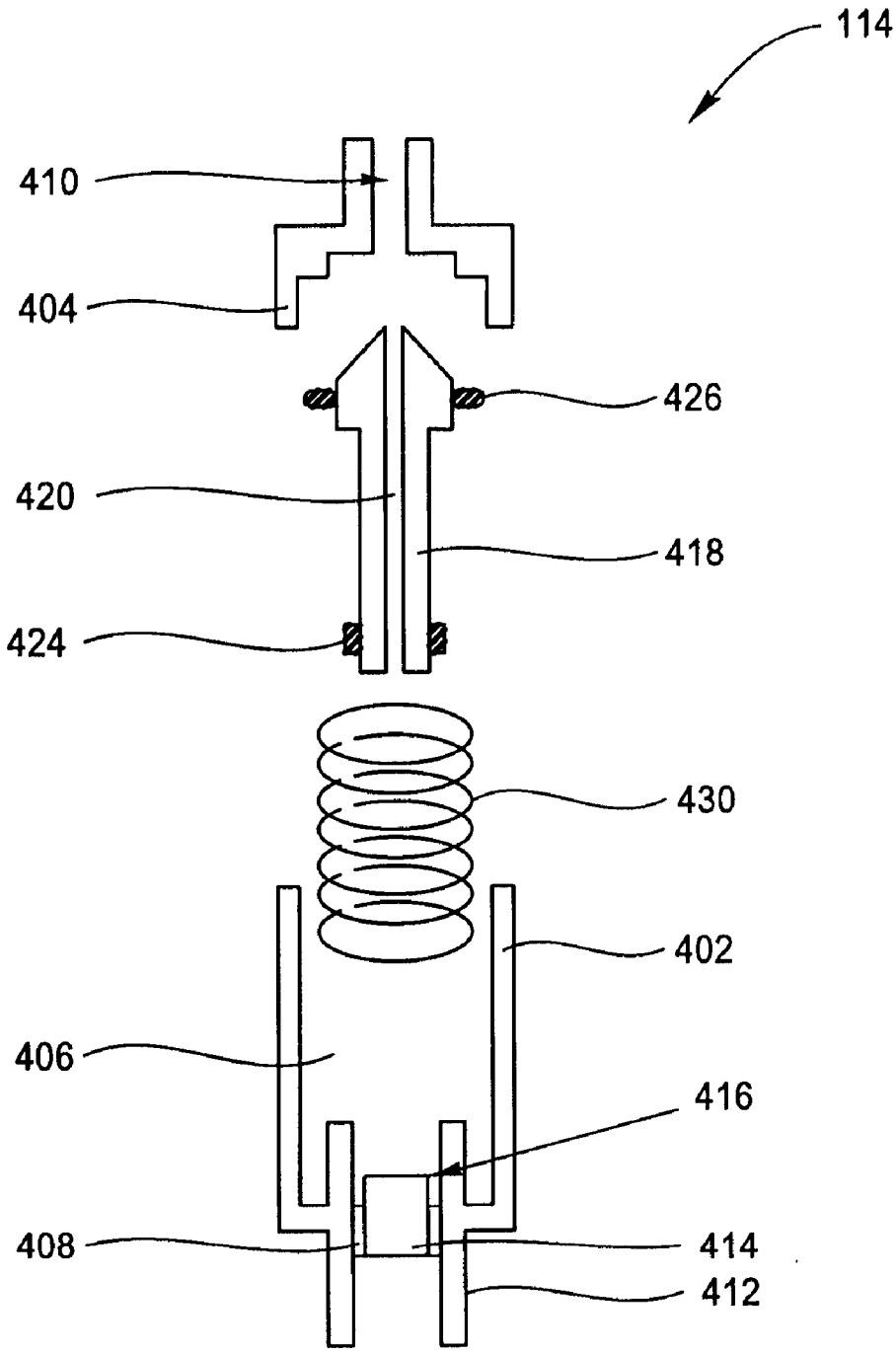
FIG. 4C shows an exploded view of the component.

Referring now to FIGS. 4A–4C of the drawings, the pressure regulator 114 is described in greater detail. The pressure regulator 114 comprises a passage defining member or cylinder 400. The cylinder 400 has a first part 402 and a removable second part 404. The cylinder 400 defines a passage 406. The passage 406 has an inlet aperture 408 arranged at an upstream end of the passage 406 and an outlet aperture 410 arranged at a downstream end of the passage 406.

The inlet aperture 408 is defined by a cylindrical portion 412 concentrically arranged with respect to the cylinder 400. The cylindrical portion 412 is arranged about a boss 414 to define an inlet aperture 408 of substantially annular cross section.

The cylindrical portion 412 projects into the passage 406 and, together with the boss 414, defines a seat defining formation 416.

A flow control member in the form of a plunger 418 is displaceably arranged in the passage 406. The plunger 418 is displaceable between a first position, as shown in FIG. 4A of the drawings, in which an upstream end of the plunger 418 seats in the seat defining formation 416, closing off the inlet aperture 408 and a second position, as shown in FIG. 4B of the drawings, in which the upstream end of the plunger 418 is clear of the boss 414 allowing ink to flow into a through bore 420 of the plunger 418 as shown by arrows 422.

A first, O-ring seal 424 is arranged proximate the upstream end of the plunger 418. When the plunger 418 is in its first position, the seal 424 seals against an internal surface of the cylindrical portion 412 inhibiting the ingress of ink into the passage 406. A second, wiper-type seal 426 is arranged proximate a downstream end of the plunger 418. The seal 426 seals against an internal surface of the wall of the cylinder 400 to facilitate the creation of a low pressure region 428 downstream of the seal 426. This low pressure region 428 arises due to ink outflow through the outlet aperture 410.

The pressure regulator 114 includes a regulating element in the form of a coil spring 430. The coil spring 430 is arranged concentrically about the plunger 418. The coil spring 430 is selected to have a spring force corresponding to the desired output pressure of the pressure regulator 114 and is arranged to maintain the plunger 418 at an equilibrium where it is about to rise off the boss 414 of the seat defining formation 416.

Thus, in use, the outlet opening 116, of the ink delivery system 100 is connected to the cylindrical portion 412 of the cylinder 400 of the pressure regulator. Ink 110 from the bladder 106 of the ink delivery system 100 is supplied, on demand, to the print head 202 through the conduit 204 via the pressure regulator 114. More particularly, when it is necessary to deliver ink to the print head 202, ink drawn through the outlet aperture 410 of the pressure regulator 114 tends to cause the plunger 418 to move from the position shown in FIG. 4A of the drawings to the position shown in FIG. 4B of the drawings. This causes ink to flow through the bore 420 of the plunger 418 and out through the outlet aperture 410 to the print head 202.

Upon cessation of printing by the print head 202, the supply of ink to the print head 202 ceases. Due to a pressure build up in the region 428 of the cylinder 400, the plunger 418 is urged back to its first position closing off the supply of ink through the outlet aperture 410 of the pressure regulator 114.

It is therefore an advantage of the invention that an ink delivery system 100 is provided which has no moving parts and, as a result, does not contribute to increased noise levels in the printer 300. Because there are no moving parts, the ink delivery system 100 is not susceptible to wear and tear which further contributes to a reduction in noise levels. The use of the propellant 112 in the ink delivery system 100 means that the canister 102 can be arranged in any orientation in or on the printer 300.

It is another advantage of the invention that an ink delivery system 100 is provided which has low part costs because of the small number of parts together with a corresponding lower assembly cost. As indicated above, it is not necessary to have the canisters 102 in a consecutive, linear arrangement which results in a smaller, more compact printer 300 being able to be designed. The canisters 102 can be placed in any orientation and can also be placed on the top of the printer 300 without adding significantly to the height of the printer 300.

Still further, the canisters 102 have a long shelf life and are not susceptible to contamination by bacteria or dust. The contents do not evaporate and, as a result, the performance characteristics of the canister 102 should not change over the lifetime of the canister 102.

The use of the pressure regulator 114 having minimal moving parts results in a small device which is suitable for inkjet printer applications where space can be at a premium. The use of the pressure regulator 114 also allows the canister 102 to have its contents at a higher pressure resulting in a smaller size of canister 102. As indicated above, this is advantageous in determining the overall size of the printer 300.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. An ink delivery system which comprises a first container;

a flexible second container containing a supply of ink to be supplied to a print head of a printer, the second container being received within the first container and the second container having an outlet opening arranged to be accessible externally of the first container;

a compressed gas interposed between an interior surface of the first container and an external surface of the second container to effect discharge of the ink through the outlet opening of the second container on demand; and a pressure regulator in fluid communication with the outlet opening of the second container, said pressure regulator comprising:

(i) a passage defining member which defines a passage having an inlet aperture and an outlet aperture;

(ii) a plunger arranged in the passage, said plunger having a bore extending there through, and being movable between a first position, in which the inlet aperture of the passage is close off, and a second position, in which the inlet aperture is open to permit the flow of ink through the bore and out through the outlet aperture of the passage;

(iii) a coil spring arranged around the plunger, said coil spring being configured to maintain ink discharged from the outlet aperture at a predetermined pressure.

2. The system of claim 1, wherein the passage defining member includes a seat defining formation arranged at the inlet aperture of the passage, the plunger, when in its first position, cooperating with the seat defining formation to inhibit the flow of ink through the bore of the plunger.

3. The system of claim 2, wherein said pressure regulator further comprises a first seal at an upstream end of the plunger so as to cooperate with the seat defining formation for closing off the inlet aperture of the passage when the plunger is in its first position, and a second seal arranged proximate a downstream end of the plunger, the second seal cooperating with an internal wall of the passage defining member to create a reduced pressure region at the outlet aperture of the passage.

4. A printer which comprises at least one print head;

an ink delivery system, said ink delivery system comprising: a first container, a flexible second container containing a supply of ink, said second container being received within the first container and defining an outlet opening arranged to be accessible externally of the first container, and a compressed gas interposed between an interior surface of the first container and an external surface of the second container to effect discharge of the ink through the outlet opening of the second container to the at least one print head on demand; and a pressure regulator, said pressure regulator comprising:

(i) a passage defining member which defines a passage having an inlet aperture and an outlet aperture, said inlet aperture being in fluid communication with the outlet opening of the second container, and said outlet aperture being in fluid communication with said at least one print head;

(ii) a plunger arranged in the passage, said plunger having a bore extending there through, and being movable between a first position, in which the inlet aperture of the passage is close off, and a second position, in which the inlet aperture is open to permit the flow of ink through the bore and out through the outlet aperture of the passage;

(iii) a coil spring arranged around the plunger, said coil spring being configured to maintain ink discharged from the outlet aperture at a predetermined pressure.

5. The printer of claim 4, wherein the passage defining member comprises a seat defining formation arranged at the inlet aperture of the passage such that, when the plunger is in its first position, the plunger cooperates with the seat defining formation to inhibit the flow of ink through the bore of the plunger, and wherein said pressure regulator further comprises a first seal and a second seal, said first seal being arranged proximate the seat defining formation for closing off the inlet aperture of the passage when the plunger is in its first position, and said second seal being arranged proximate a downstream end of the plunger, the second seal cooperating with an internal wall of the passage defining member to create a reduced pressure region at the outlet aperture of the passage.

* * * * *